US008208662B2

(12) United States Patent
Chen

(10) Patent No.: US 8,208,662 B2
(45) Date of Patent: Jun. 26, 2012

(54) MICROELECTROMECHANICAL SYSTEM MICROPHONE STRUCTURE AND MICROELECTROMECHANICAL SYSTEM MICROPHONE PACKAGE STRUCTURE

(75) Inventor: Li-Che Chen, Pingtung County (TW)

(73) Assignee: United Microelectronics Corp., Hsinchu (TW)

( * ) Notice: Subject to any disclaimer, the term of this patent is extended or adjusted under 35 U.S.C. 154(b) by 953 days.

(21) Appl. No.: 12/211,650

(22) Filed: Sep. 16, 2008

(65) Prior Publication Data

US 2010/0067728 A1 Mar. 18, 2010

(51) Int. Cl.
*H04R 25/00* (2006.01)

(52) U.S. Cl. ..... 381/174; 381/175; 381/113; 381/191; 257/414; 257/415; 257/416; 257/417; 257/245; 257/254; 438/48

(58) Field of Classification Search ..... 381/174–175, 381/113, 191; 257/245, 254, 414–419; 438/49–98
See application file for complete search history.

(56) References Cited

U.S. PATENT DOCUMENTS 7,202,101 B2 4/2007 Gabriel et al.
7,642,575 B2 * 1/2010 Wong et al. ..... 257/254
7,880,367 B2 * 2/2011 Nakatani ..... 310/331

* cited by examiner

*Primary Examiner* — Steven Loke
*Assistant Examiner* — Cuong Nguyen
(74) *Attorney, Agent, or Firm* — WPAT., P.C.; Justin King

(57) ABSTRACT

A microelectromechanical system microphone structure including a substrate, a first device and at least one second device is provided. The first device is disposed on the substrate and including a first upper electrode and a first lower electrode disposed between the first upper electrode and the substrate. The second device is disposed on the substrate, surrounding the first device and including a second upper electrode and a second lower electrode disposed between the second upper electrode and the substrate. The second upper electrode includes a plurality of first conductive layers and first plugs. The first conductive layers are arranged in steps, and the first plug is disposed between the adjacent first conductive layers. The second lower electrode includes a plurality of second conductive layers and a plurality of second plugs. The second conductive layers are arranged in steps, and the second plug is disposed between the adjacent second conductive layers.

10 Claims, 2 Drawing Sheets

MICROELECTROMECHANICAL SYSTEM MICROPHONE STRUCTURE AND MICROELECTROMECHANICAL SYSTEM MICROPHONE PACKAGE STRUCTURE

BACKGROUND OF THE INVENTION

1. Field of the Invention

The present invention generally relates to a semiconductor device, in particular, to a microelectromechanical system microphone structure and a microelectromechanical system microphone package structure.

2. Description of Related Art

Microelectromechanical System Device (MEMS device) refers to a microelectromechanical device manufactured in a miniaturized package structure with a technology extremely similar to a technology for manufacturing an integrated circuit (IC). However, the MEMS device interacts with a surrounding environment in more manners than a conventional IC, such as interaction in mechanics, optics, or magnetic force. The MEMS device includes tiny electromechanical devices, such as an accelerometer, a switch, a capacitor, an inductor, and a microphone. The MEMS device manufactured with an MEMS technology has many advantages. For example, an MEMS microphone manufactured with the MEMS technology has features of light weight, small volume, and preferred signal quality. Therefore, the MEMS microphone gradually becomes the mainstream of microphones.

Generally speaking, the MEMS microphone has been improved both in reception efficiency and stability, and can provide clear and fluent voice quality either in a noisy environment or in high-speed movement. However, since a diaphragm for reception is a plane, phase noises are caused, i.e., a sounder and surrounding environmental noises may be heard by a receiver, so the receiver is interfered when understanding an audio message. On the contrary, a directional microphone is provided with a function of distinguish the direction of a sound source, which may enhance the intensity of sound in a specific direction and reduce the intensity of sound from other directions, so that the receiver may hear a clear and correct audio message. Therefore, along with the rapid development of personal electronic products such as mobile phones, personal digital assistants (PDAs), notebooks, and hearing aids, an MEMS microphone with a directional function is in urgent need in the industry.

SUMMARY OF THE INVENTION

Accordingly, the present invention is directed to a microelectromechanical system microphone structure with a directional function.

The present invention is further directed to a microelectromechanical system microphone package structure, which may distinguish sound sources in different directions.

The present invention provides a microelectromechanical system microphone structure, which includes a substrate, a first device, and at least one second device. The first device is disposed on the substrate, and includes a first upper electrode and a first lower electrode disposed between the first upper electrode and the substrate. The second device is disposed on the substrate and surrounding the first device, and includes a second upper electrode and a second lower electrode disposed between the second upper electrode and the substrate. The second upper electrode includes a plurality of first conductive layers and a plurality of first plugs, the first conductive layers are arranged in steps, and each of the first plugs is disposed between the adjacent first conductive layers. The second lower electrode includes a plurality of second conductive layers and a plurality of second plugs, the second conductive layers are arranged in steps, and each of the second plugs is disposed between the adjacent second conductive layers.

In an embodiment of the present invention, the first conductive layers are parallel to the second conductive layers.

In an embodiment of the present invention, a horizontal distance between the first conductive layer and the first device is increased as a height of the first conductive layer is increased, and a horizontal distance between a second conductive layer and the first device is increased as a height of the second conductive layer is increased.

In an embodiment of the present invention, each of the first conductive layers includes at least one hole.

In an embodiment of the present invention, the first upper electrode includes at least one hole.

In an embodiment of the present invention, the microelectromechanical system microphone structure further includes a dielectric layer, disposed between the uppermost first conductive layer and the substrate.

In an embodiment of the present invention, the microelectromechanical system microphone structure further includes a dielectric layer, disposed between the uppermost second conductive layer and the substrate.

In an embodiment of the present invention, the microelectromechanical system microphone structure further includes a plug, disposed between the uppermost first conductive layer and the substrate.

In an embodiment of the present invention, the microelectromechanical system microphone structure further includes a plug, disposed between the lowermost first conductive layer and the substrate.

In an embodiment of the present invention, the microelectromechanical system microphone structure further includes a plug, disposed between the uppermost second conductive layer and the substrate.

In an embodiment of the present invention, the microelectromechanical system microphone structure further includes a plug, disposed between the lowermost second conductive layer and the substrate.

The present invention further provides a microelectromechanical system microphone package structure, which includes a base plate and a plurality of chips disposed on the base plate. An active area on each of the chips is disposed with a microelectromechanical system microphone structure, each of the active areas has a normal line, and the normal lines of the chips are not parallel to each other.

In an embodiment of the present invention, the normal lines extend toward the same point.

In an embodiment of the present invention, the microelectromechanical system microphone package structure further includes at least one holder, which is disposed between the base plate and a chip, so as to adjust an inclination angle of the chips.

The microelectromechanical system microphone structure and the microelectromechanical system microphone package structure in the present invention include a plurality of unparallel planes for receiving accoustic waves. Therefore, the microelectromechanical system microphone structure and the microelectromechanical system microphone package structure may distinguish the direction of a sound source, so as to increase the intensity of sound from a specific direction and reduce the intensity of sound from other directions based on calculation, thereby reducing phase noises. In other words, the microelectromechanical system microphone structure and the microelectromechanical system microphone package structure have a directional function to reduce noises which may be heard by a receiver. Thus, the receiver may hear a clear and correct audio message.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
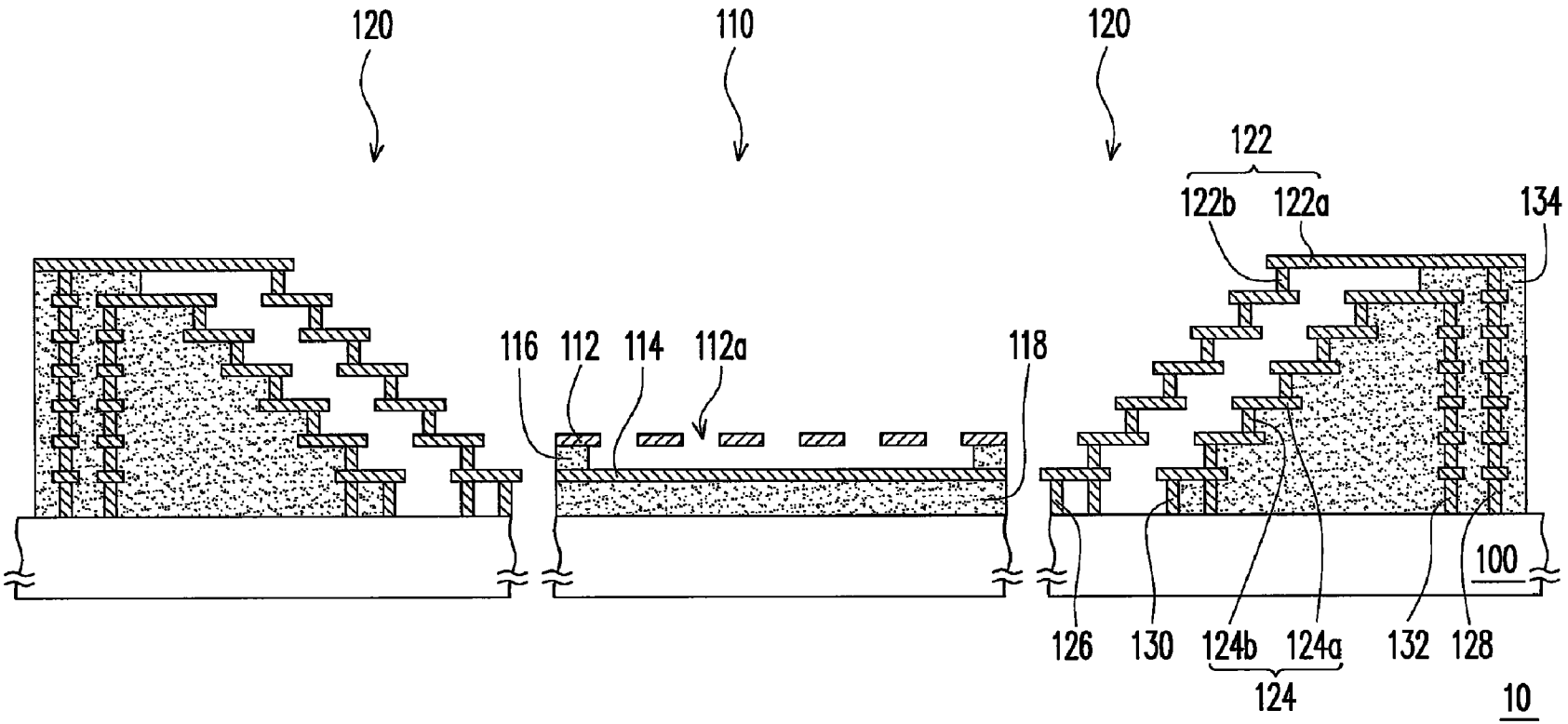
FIG. 1 is a schematic cross-sectional view of a microelectromechanical system microphone structure according to a first embodiment of the present invention.

Reference will now be made in detail to the present preferred embodiments of the invention, examples of which are illustrated in the accompanying drawings. Wherever possible, the same reference numbers are used in the drawings and the description to refer to the same or like parts.

The First Embodiment

FIG. 1 is a schematic cross-sectional view of a microelectromechanical system microphone structure according to a first embodiment of the present invention.

Referring to FIG. 1, the microelectromechanical system microphone structure 10 includes a substrate 100, a first device 110, and a second device 120.

The first device 110 is disposed on the substrate 100, and includes a first upper electrode 112, a first lower electrode 114, a dielectric layer 116, and a dielectric layer 118. In this embodiment, the first upper electrode 112 includes, for example, a plurality of holes 112*a*. Therefore, the first upper electrode 112 is a mesh electrode, and the material thereof may be polysilicon, polysilicon metal, aluminum, tungsten, copper, titanium, or other conductive materials. The first lower electrode 114 is disposed between the first upper electrode 112 and the substrate 100, which may be, for example, a whole piece of electrode, and the material may be polysilicon, polysilicon metal, aluminum, tungsten, copper, titanium, or other conductive materials. In this embodiment, the dielectric layer 116 is partially disposed between the first upper electrode 112 and the first lower electrode 114, so that a part of the first upper electrode 112 is suspended. The dielectric layer 118 is disposed between the whole first lower electrode 114 and the substrate 100. Of course, in other embodiments (not shown), the dielectric layer 118 may also be partially disposed between the first lower electrode 114 and the substrate 100, so that a part of the first lower electrode 114 is suspended. Furthermore, in the present invention, the first upper electrode and the first lower electrode are not limited in configuration and may be mesh electrodes, stripped electrodes, whole pieces of electrodes, and electrodes in other forms.

The second device 120 is disposed on the substrate 100 and surrounding the first device 110. In other words, the second device 120, for example, surrounds the first device 110. The second device 120 includes a second upper electrode 122 and a second lower electrode 124. The second upper electrode 122 is a diaphragm, and includes a plurality of first conductive layers 122*a* and a plurality of first plugs 122*b*. The first conductive layers 122*a* are arranged in steps, and each of the first plugs 122*b* is disposed between the adjacent first conductive layers 122*a*. The second lower electrode 124 is disposed between the second upper electrode 122 and the substrate 100, and includes a plurality of second conductive layers 124*a* and a plurality of second plugs 124*b*. The second conductive layers 124*a* are arranged in steps, and each of the second plugs 124*b* is disposed between the adjacent second conductive layers 124*a*. The material of the first conductive layers 122*a* and the second conductive layers 124*a* may be polysilicon, polysilicon metal, aluminum, tungsten, copper, titanium, or other conductive materials, and the material of the first plugs 122*b* and the second plugs 124*b* may be copper, tungsten, aluminum, molybdenum, gold, platinum, or an alloy thereof. In this embodiment, the first conductive layers 122*a* are, for example, parallel to the second conductive layers 124*a*. Moreover, a horizontal distance between a first conductive layer 122*a* and the first device 110 is increased as a height of the first conductive layer 122*a* is increased, and a horizontal distance between a second conductive layer 124*a* and the first device 110 is increased as a height of the second conductive layer 124*a* is increased. In other words, the second upper electrode 122 and the second lower electrode 124 are similar in structure and parallel to each other. Furthermore, in other embodiments (not shown), the first conductive layers and the second conductive layers may also include holes, so as to increase flexibility and accoustic wave transmission capacity of the second upper electrode and the second lower electrode. Furthermore, the present invention does not limit the number of the first conductive layers in the second upper electrode and the number of the second conductive layers in the second lower electrode. In other embodiments, the second upper electrode may include another number of first conductive layers, and the second lower electrode may also include another number of second conductive layers.

In this embodiment, plugs 126, a plug 128, a plug 130, and a plug 132 are further disposed between the substrate 100 and the lowermost first conductive layer 122*a*, the uppermost first conductive layer 122*a*, the lowermost second conductive layer 124*a*, and the uppermost second conductive layer 124*a*, respectively, so as to stabilize the structures of the second upper electrode 122 and the second lower electrode 124. Moreover, in this embodiment, the second device 120 further includes a dielectric layer 134 which is, for example, disposed between the uppermost first conductive layer 122*a* and the substrate 100 and between the uppermost second conductive layer 124*a* and the substrate 100, so as to further stabilize the structures of the second upper electrode 122 and the second lower electrode 124. In addition, the dielectric layer 134 is further disposed between the second lower electrode 124 and the substrate 100, so as the second lower electrode 124 is not able to vibrate or a vibration extent of the second lower electrode 124 is much smaller than that of the second upper electrode 122. Furthermore, in other embodiments, only the plugs or dielectric layer is disposed between the uppermost first conductive layer and the substrate and between the uppermost second conductive layer and the substrate, which is not limited in the present invention.

In this embodiment, the second upper electrode 122 and the second lower electrode 124 of the second device 120 form an included angle with the substrate 100, so that the second upper electrode 122 of the second device 120 faces the first upper electrode 112 of the first device 110. In other words, the normal line of the second upper electrode 122 is not parallel to the normal line of the first upper electrode 112, so that the microelectromechanical system microphone structure 10 includes a plurality of planes for receiving accoustic waves.

In this manner, the microelectromechanical system microphone structure 10 may distinguish the direction of a sound source. Furthermore, in this embodiment, for example, the first device 110 is surrounded by two second devices 120, but the present invention is not limited thereto. In other embodiments, the microelectromechanical system microphone structure may also include one second device or another number of second devices.

In this embodiment, the microelectromechanical system microphone structure includes the first device and the second device. The first device includes the upper and lower electrodes parallel to the substrate, and the second device includes the upper and lower electrodes in a stepped form. The first device and the second device constitute a plurality of planes for receiving accoustic waves, so that the microelectromechanical system microphone structure may distinguish the direction of a sound source, so as to increase the intensity of sound from a specific direction and reduce the intensity of sound from other directions based on calculation, thereby reducing phase noises. That is to say, the microelectromechanical system microphone structure has a directional function to reduce noises which may be heard by a receiver. Thus, the receiver may hear a clear and correct audio message. Therefore, the microelectromechanical system microphone structure may be widely used in personal electronic products such as mobile phones, personal digital assistants (PDAs), notebooks, and hearing aids, so as to improve communication between the user and the receiver.

The Second Embodiment

Figure 2:
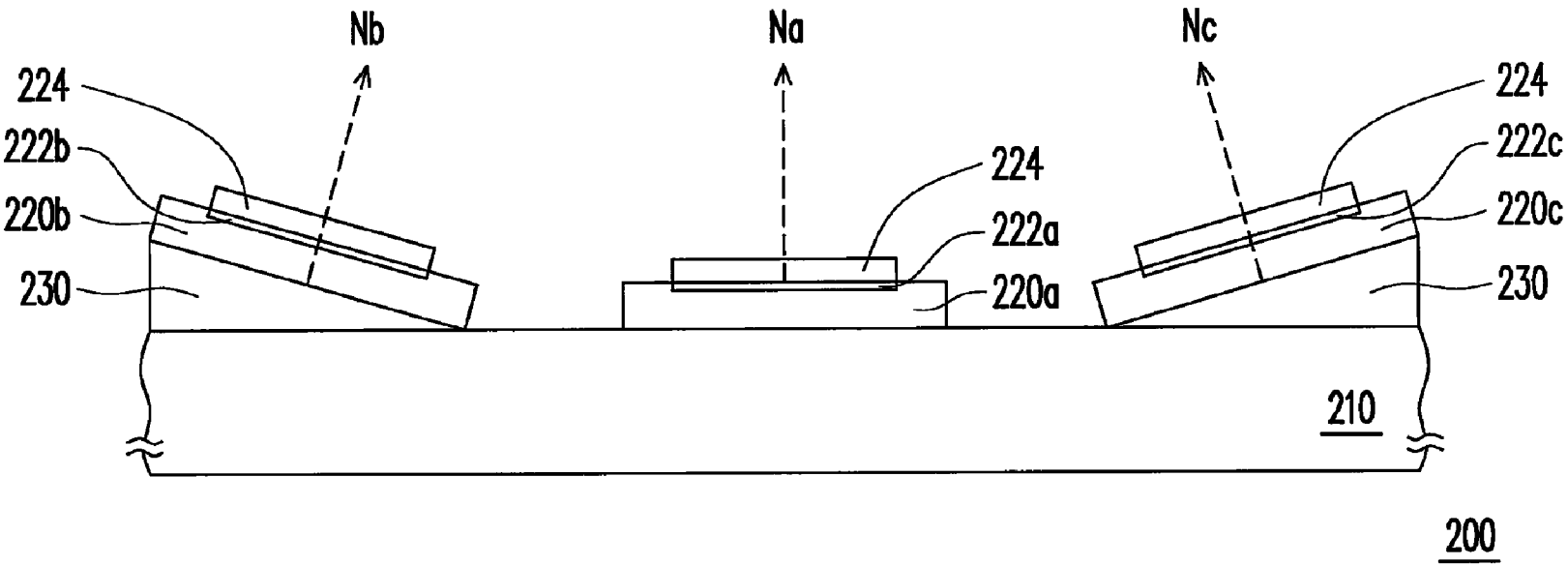
FIG. 2 is a schematic cross-sectional view of a microelectromechanical system microphone package structure according to a second embodiment of the present invention.

FIG. 2 is a schematic cross-sectional view of a microelectromechanical system microphone package structure according to a second embodiment of the present invention.

Referring to FIG. 2, the microelectromechanical system microphone package structure 200 includes a base plate 210, a plurality of chips 220*a*, 220*b*, and 220*c*, and holders 230. The chips 220*a*, 220*b*, and 220*c* are disposed on the base plate 210, and for example, the chip 220*a* is surrounded by the chips 220*b* and 220*c*.

The chips 220*a*, 220*b*, and 220*c* respectively have active areas 222*a*, 222*b*, and 222*c*, and each of the active areas 222*a*, 222*b*, and 222*c* is provided with a microelectromechanical system microphone structure 224. In other words, the chips 220*a*, 220*b*, and 220*c* are MEMS microphone chips. The structure of the microelectromechanical system microphone structure 224 may be similar to the structure of the first device 110 in the first embodiment or other structures, which is not limited in the present invention.

In this embodiment, the active area 222*a* of the chip 220*a* is, for example, parallel to the surface of the base plate 210. The holders 230 are disposed between the chips 220*b* and 220*c* and the base plate 210, so as to adjust inclination angles of the chips 220*b* and 220*c*, so that the active areas 222*b* and 222*c* of the chips 220*b* and 220*c* face the active area 222*a* of the chip 220*a*. In other words, in the microelectromechanical system microphone package structure 200, the active areas 222*a*, 222*b*, and 222*c* respectively have normal lines Na, Nb, and Nc, which are not parallel to each other. The normal lines Na, Nb, and Nc, for example, extend toward the same point. In other words, the microelectromechanical system microphone package structure 200 includes a plurality of planes for receiving accoustic waves, so as to distinguish the direction of a sound source.

It should be noted that, this embodiment takes three chips 220*a*, 220*b*, and 220*c* as an example, but the present invention does not limit the number of the chips. In other embodiments, the microelectromechanical system microphone package structure may also include two chips or another number of chips.

In this embodiment, the positions of the chips 220*b*, and 220*c* are adjusted in a package level, so as the normal lines Na, Nb, and Nc of the active areas of the plurality of chips are unparallel to each other. In this manner, the microelectromechanical system microphone package structure includes a plurality of planes for receiving accoustic waves to distinguish the direction of a sound source, so as to increase the intensity of sound from a specific direction and reduce the intensity of sound from other directions based on calculation, thereby reducing phase noises. In other words, the microelectromechanical system microphone package structure has a directional function to reduce noises which may be heard by a receiver. Thus, the receiver may hear a clear and correct audio message. Therefore, the microelectromechanical system microphone structure may be widely used in personal electronic products such as mobile phones, personal digital assistants (PDAs), notebooks, and hearing aids, so as to improve communication between the user and the receiver.

In view of the above, the microelectromechanical system microphone structure and the microelectromechanical system microphone package structure in the present invention include a plurality of unparallel planes for receiving accoustic waves. Therefore, the microelectromechanical system microphone structure and the microelectromechanical system microphone package structure may distinguish the direction of a sound source, so as to increase the intensity of sound from a specific direction and reduce the intensity of sound from other directions based on calculation, thereby reducing phase noises. In other words, the microelectromechanical system microphone structure and the microelectromechanical system microphone package structure have a directional function to reduce noises which may be heard by a receiver. Thus, the receiver may hear a clear and correct audio message. Therefore, the microelectromechanical system microphone structure and the microelectromechanical system microphone package structure may be widely used in personal electronic products such as mobile phones, personal digital assistants (PDAs), notebooks, and hearing aids, so as to improve communication between the user and the receiver.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A microelectromechanical system microphone structure, comprising:

a substrate;

a first device, disposed on the substrate, comprising:

a first upper electrode; and a first lower electrode, disposed between the first upper electrode and the substrate; and at least one second device, disposed on the substrate and surrounding the first device, comprising:

a second upper electrode, comprising a plurality of first conductive layers and a plurality of first plugs, wherein the first conductive layers are arranged in steps and each of the first plugs is disposed between the adjacent first conductive layers; and a second lower electrode, disposed between the second upper electrode and the substrate, comprising a plurality of second conductive layers and a plurality of second plugs, wherein the second conductive layers are arranged in steps, and each of the second plugs is disposed between the adjacent second conductive layers.

2. The microelectromechanical system microphone structure according to claim 1, wherein the first conductive layers are parallel to the second conductive layers.

3. The microelectromechanical system microphone structure according to claim 1, wherein a horizontal distance between the plurality of first conductive layers and the first device is increased as a height of each of the plurality of first conductive layers is increased, and a horizontal distance between the plurality of second conductive layers and the first device is increased as a height of each of the plurality of second conductive layers is increased.

4. The microelectromechanical system microphone structure according to claim 1, wherein the first upper electrode comprises at least one hole.

5. The microelectromechanical system microphone structure according to claim 1, further comprising a dielectric layer, disposed between the uppermost first conductive layer and the substrate.

6. The microelectromechanical system microphone structure according to claim 1, further comprising a dielectric layer, disposed between the uppermost second conductive layer and the substrate.

7. The microelectromechanical system microphone structure according to claim 1, further comprising a plug, disposed between the uppermost first conductive layer and the substrate.

8. The microelectromechanical system microphone structure according to claim 1, further comprising a plug, disposed between the lowermost first conductive layer and the substrate.

9. The microelectromechanical system microphone structure according to claim 1, further comprising a plug, disposed between the uppermost second conductive layer and the substrate.

10. The microelectromechanical system microphone structure according to claim 1, further comprising a plug, disposed between the lowermost second conductive layer and the substrate.

* * * * *